United States Patent [19]

Oglander et al.

[11] 4,194,646

[45] Mar. 25, 1980

[54] MANUALLY OPERATED LABEL DISPENSING MACHINE

[76] Inventors: Allen H. Oglander, 9 Sackston Woods, St. Louis, Mo. 63141; Richard E. Shannon, 355 Albert, St. Louis, Mo. 63131

[21] Appl. No.: 941,953

[22] Filed: Sep. 13, 1978

[51] Int. Cl.[2] ..... B65C 9/18

[52] U.S. Cl. ..... 221/73; 156/584

[58] Field of Search ..... 221/70, 71, 73, 74; 156/541, 584; 225/10, 11, 15

[56] References Cited

U.S. PATENT DOCUMENTS 4,053,345 10/1977 Hamisch, Jr. ..... 156/584 X

FOREIGN PATENT DOCUMENTS 494994 8/1950 Belgium ..... 221/70

*Primary Examiner*—Stanley H. Tollberg
*Attorney, Agent, or Firm*—Ralph W. Kalish

[57] ABSTRACT

A manually operated label dispensing machine adapted to receive web forming backing material carrying readily detachable, adhesive-coated labels thereon; there being a discharge edge presented for travel thereover of the backing material to effect parting of the material from the supported labels for freeing of the latter. A drive roller is carried upon a drive shaft for cooperating with a driven roller for gripping therebetween the backing material causing pulling of the same about the discharge edge. The drive roller is mounted for rotation by manually applied torque; and the driven roller is supported upon a swing frame for selected disposition in either operative relationship with said drive roller or in inoperative condition. In another form of the invention for use with discrete sheet-forming backing material, the drive roller is mounted upon the swing frame with the drive roller journalled upon the main frame and with cooperative latch elements securing the swing frame in position to maintain the drive and driven rollers in operative relationship.

18 Claims, 12 Drawing Figures

MANUALLY OPERATED LABEL DISPENSING MACHINE

BACKGROUND AND SUMMARY OF THE INVENTION

This invention relates in general to label dispensing and, more particularly, to machines which are manually operable for facilitating the removal of adhesive coated labels from the supporting web-forming material and from discrete sheets.

Heretofore, in the field of label dispensing wherein labels are to be withdrawn from a backing member, efforts have been directed to developing machines which are motor driven and which encompass control switches operable by contact with the parting label for effecting interruption of operation of the related motor and with resumption of operation upon withdrawal of the freed label. Exemplary of devices of this character is that shown in the patent to J. A. West et al. U.S. Pat. No. 3,186,589, as well as that to Oglander et al. U.S. Pat. No. 3,941, 278. Other efforts utilizing a control key for brining about the desired interrupted action of the associated motor are of the type set forth in Severance U.S. Pat. No. 3,537,933 and Oglander et al. U.S. Pat. No. 3,991,906. Additional dispenser embodiments are shown in the Petterson U.S. Pat. No. 2,802,598 and the Sohn U.S. Pat. No. 3,169,895 both of which also incorporate motors and associated control switches, together with requisite circuitry.

Thus, to the present time, dispensing of labels from webs or the like has been effected by motor operated machines which manifestly are relatively costly in production and which during operation necessitate close supervision so that in the event of any breakdown or malfunction repair efforts must be promptly undertaken to limit the down-time to whatever extent feasible.

Therefore, it is an object of the present invention to provide a label dispensing machine for use with adhesive coated labels carried upon webs and backing sheets, which efficiently and reliably operate to part the labels from such backing, but which machine is devoid of the usual electric motor and the associated circuitry and control switches, with there being manually operble means for causing travel of the backing material through the machine.

It is a further object of the present invention to provide a manually operated label dispensing machine which may, manifestly, be operated at a speed determined entirely by the operator so that if more rapid production is desired the operator need merely apply greater torque and if a lesser rate of production is adequate, the operator may commensurately decrease the physical efforts exercised.

It is another object of the present invention to provide a label dispensing machine of character stated which manifestly is comprised of a paucity of sturdy components which reliably coact to provide the intended action with a consistency and a relative proof against breakdown not hitherto attainable in machines for like purposes.

It is another object of the present invention to provide a machine of the character state which constitutes an independent unitary construction which may be used at any location convenient for the user or as may be dictated for facilitating the operation at hand without concern as to the location of a source of electrical power or the like.

It is a furthe object of the present invention to provide a machine of the character stated which is adapted for use with discrete, single-page backing sheets having limited selvedge.

Label dispensing machines of the present invention are readily transportable; do not need the supervision of skilled personnel and may be easily operated by untutored individuals; may be manufactured most inexpensively, being amenable to high volume production; and are extremely reliable in usage.

DESCRIPTION OF PRACTICAL EMBODIMENTS

Figure 1:
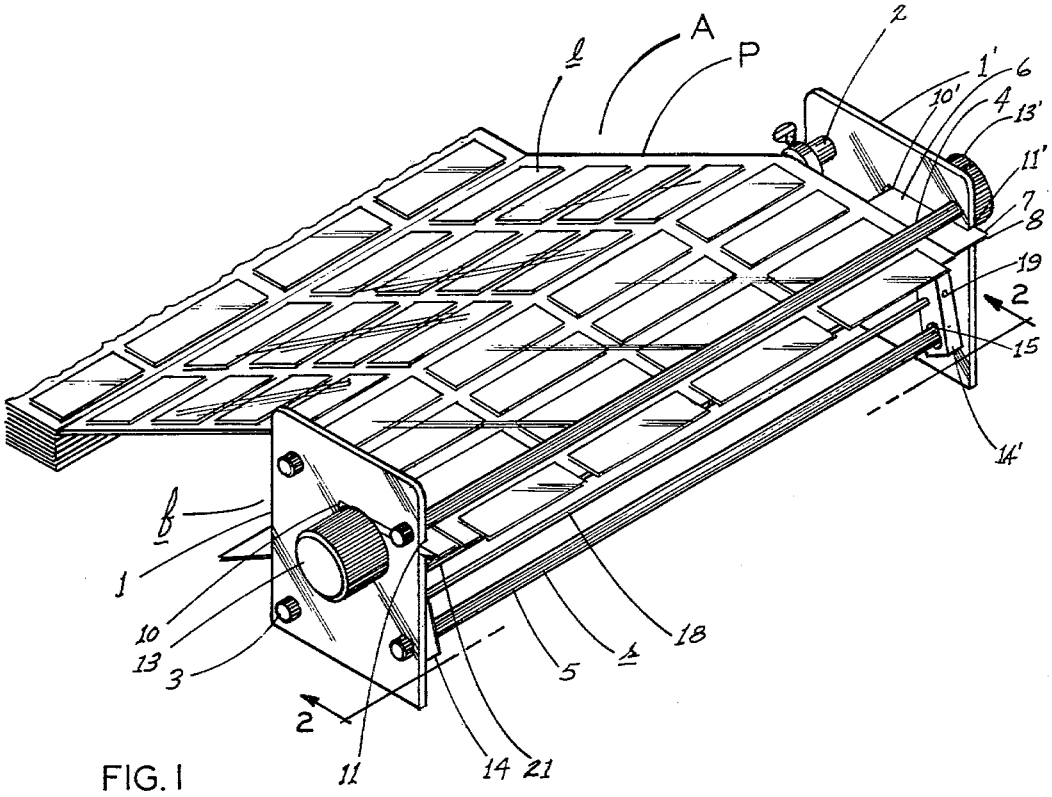
FIG. 1 is a perspective view of a label dispensing machine constructed in accordance with and embodying the present invention, illustrating a label-backing web fed to the machine.
Figure 2:
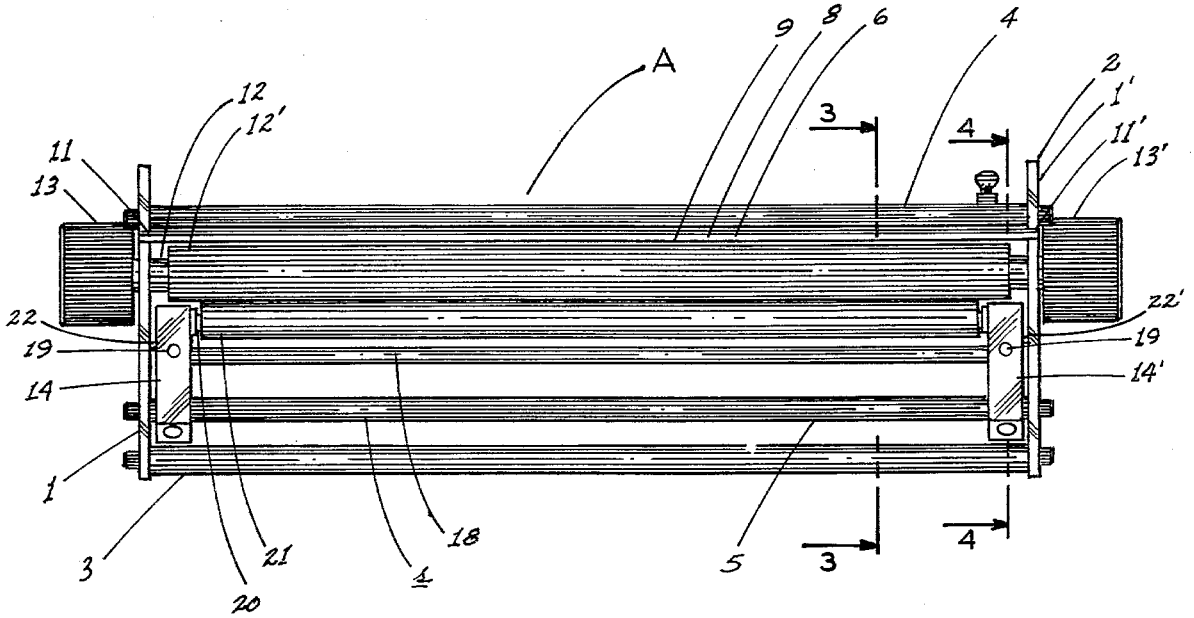
FIG. 2 is a front elevational view of the machine.

Referring now by reference numerals to the drawings which illustrate practical embodiments of the present invention, A generally designates a manually operable label dispensing machine having a main frame *f* comprised of a pair of opposed, planarwise parallel, horizontally spaced-apart side plates 1,1' maintained in such relative position by upper and lower, transversely extending rearward rods 2,3, respectively, which are suitably fixed in their end portions within said plates 1,1'; and upper and lower forward rods 4,5, respectively, also rigid in said plates 1,1' thereby conducing to a sturdy construction. Provided for disposition between side plates 1,1' in planarwise perpendicular relationship thereto and also extending transversely therebetween is a work support plate 6, the forward portion 7 of which projects beyond the forward vertical edges of side plates 1,1' and having a leading edge 8 which tapers downwardly and rearwardly, as at 9, for purposes presently appearing. Support plate 6 may be mounted in any manner. However, for the sake of simplicity of assembly, the lateral edge portions thereof may be received within complementary horizontal slot-like apertures 10, 10', respectively, in said plates 1,1'; the forward edge portions of said plate 6 being provided with an edge notch 11,11', respectively, for accommodating the proximate portion of the associated side plate 1,1' intervening between the forward extremity of the related aperture 11,11', as the case may be, and the forward, vertical edge of the particular side plate. Thus, support plate 6 may be readily fitted to side plates 1,1' during assembly and held firmly against unauthorized displacement by reason of the spacing effected by rods 2, 3, 4, and 5, as well as the limiting of aperture penetration caused by notches 11,11'.

Figure 3:
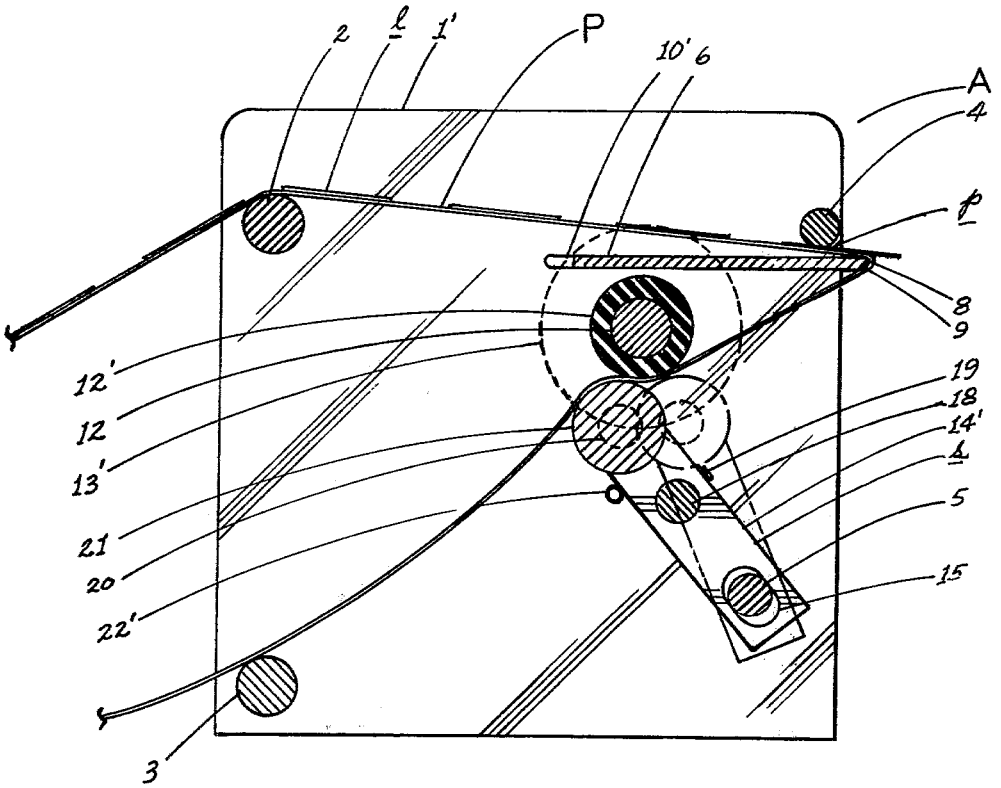
FIG. 3 is a vertical transverse sectional view taken on the line 3—3 of FIG. 2.
Figure 4:
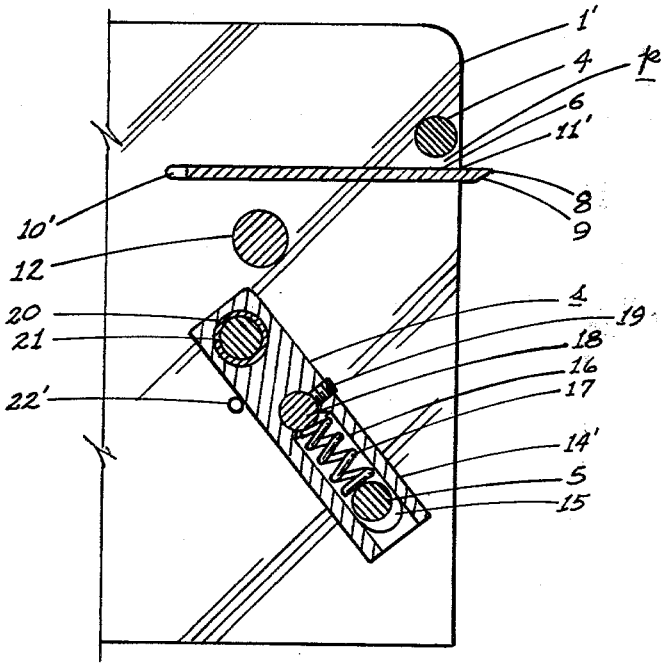
FIG. 4 is a vertical transverse sectional view taken on the line 4—4 of FIG. 2.
Figure 5:
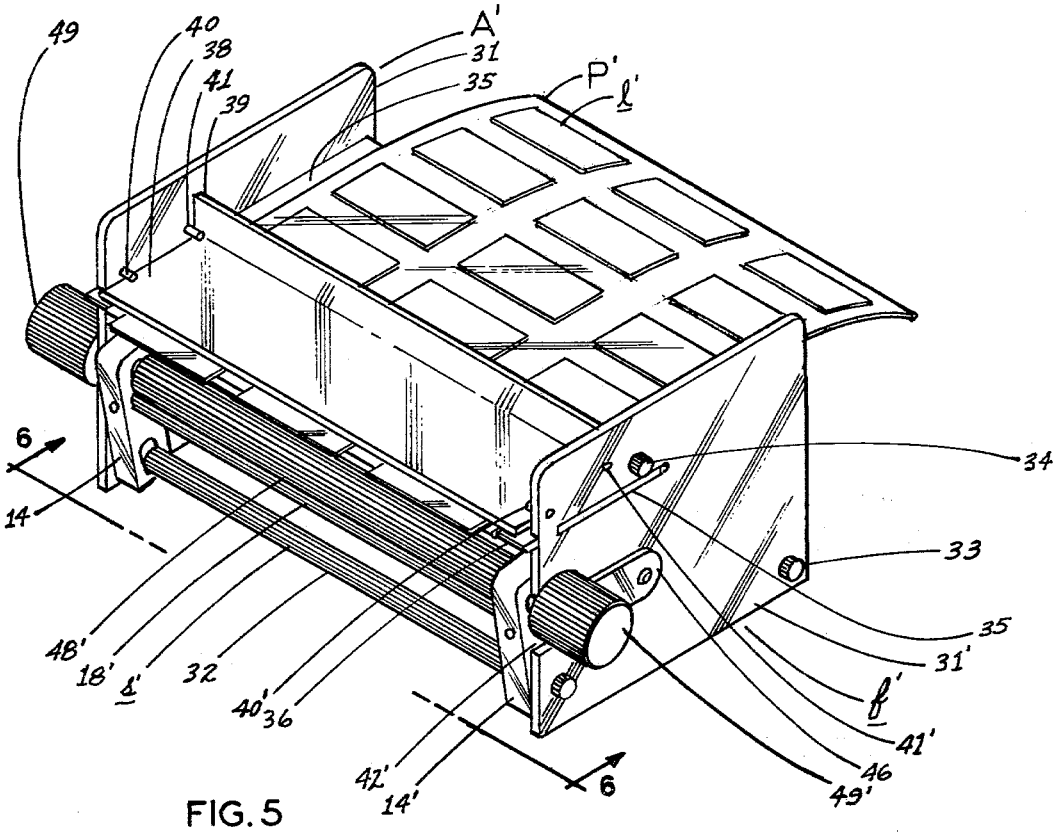
FIG. 5 is a perspective view of another form of label dispensing machine constructed in accordance with and embodying the present invention, illustrating a label-backing sheet fed to the machine.
Figure 6:
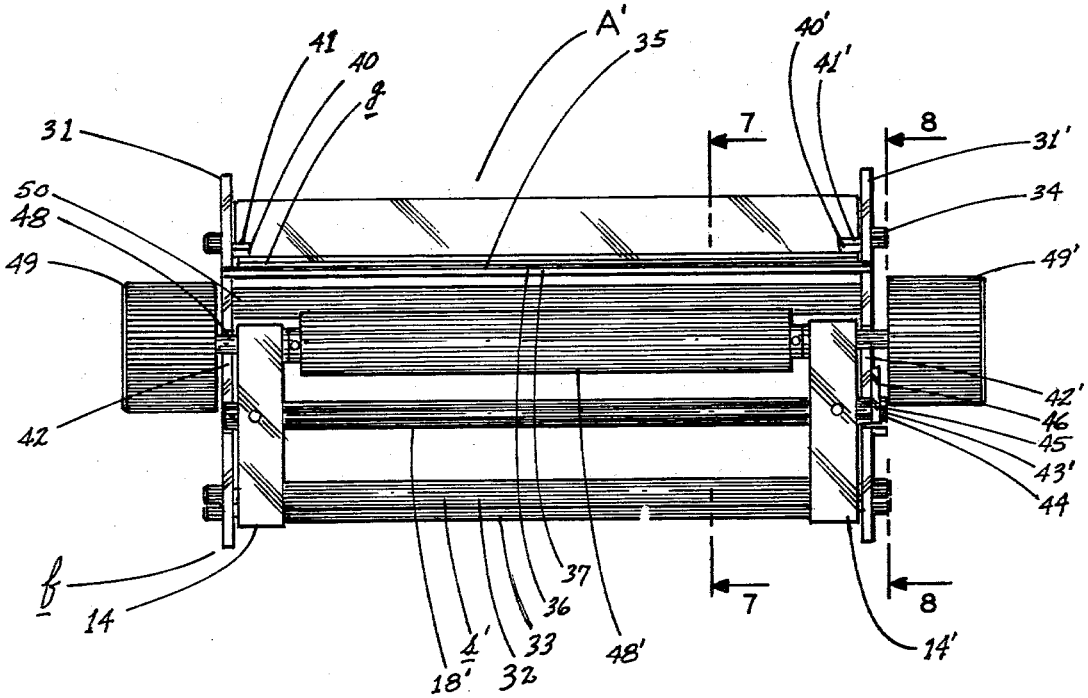
FIG. 6 is a front elevational view of the machine illustrated in FIG. 5.
Figure 7:
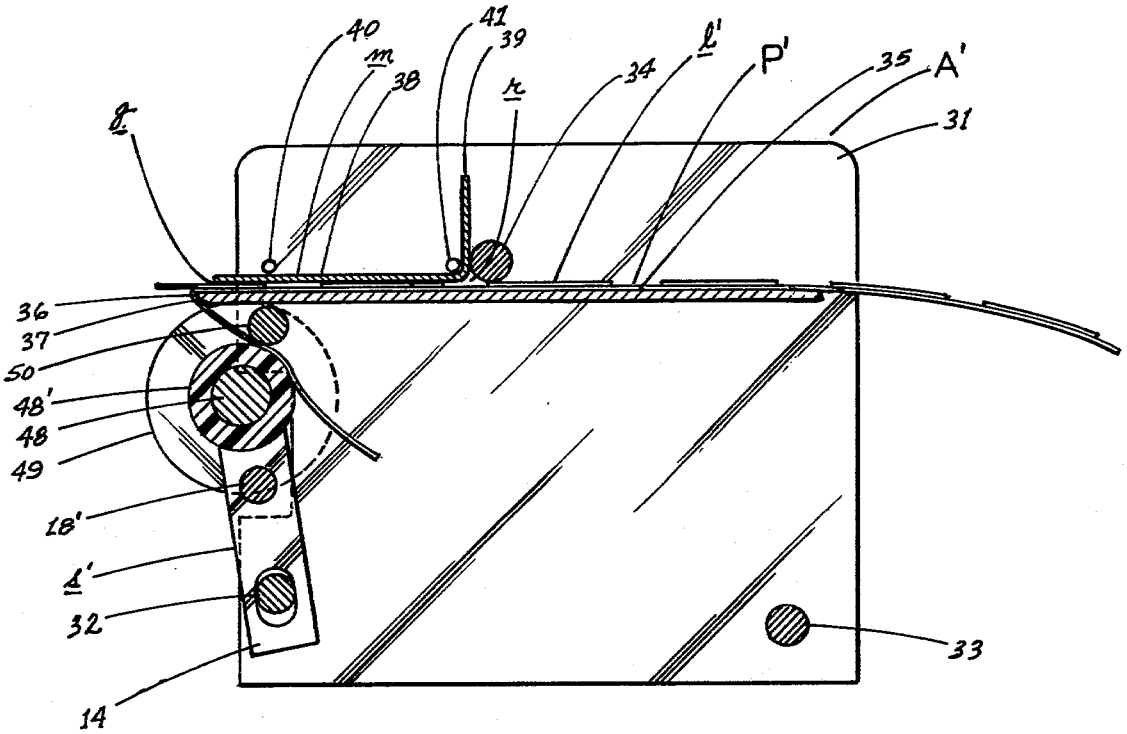
FIG. 7 is a vertical transverse sectional view taken on the line 7—7 of FIG. 6.
Figure 8:
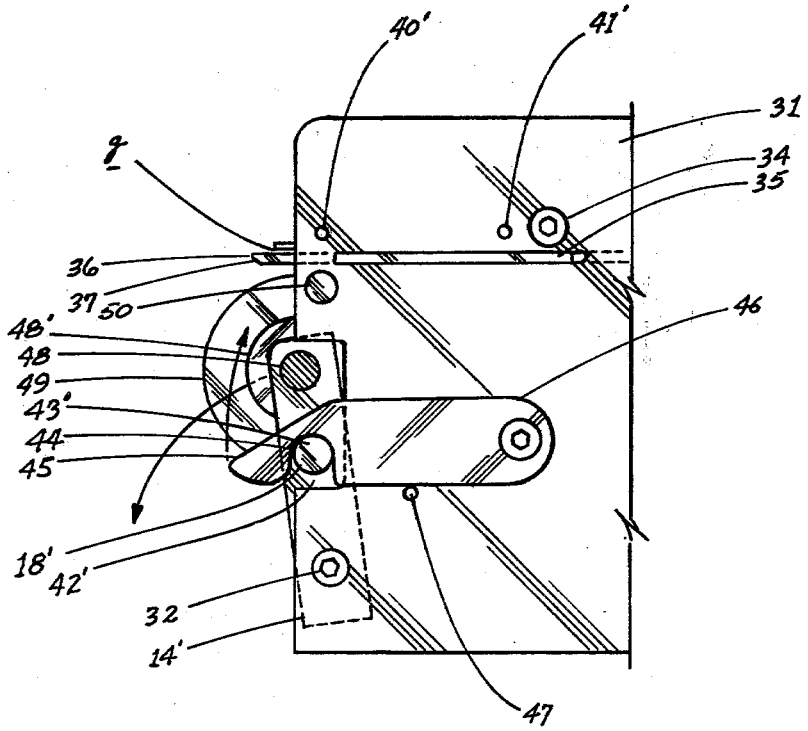
FIG. 8 is a side elevational view, in partial section, taken on the line 8—8 of FIG. 6.

With reference to FIGS 3 and 4, it will be noted that rod 4 is located immediately above the forward portion of plate 6 for cooperating therewith to define a guide path *p* for a backing web P progressing from a source of supply (not shown) for directing same to work support plate leading edge 8 as will be shown more fully hereinbelow; with spacing between rod 4 and plate 6 being commensurate with the combined thickness of the labels, and web to assure the exertion of requisite pressure thereon.

Disposed beneath support plate 6, in its rearward portion, is a drive shaft 12 journalled in its end portions within bearings provided within side plates 1,1' and extending at its ends beyond said plates 1,1' for mounting immediately laterally outwardly of said plates 1,1' knurled control knobs 13, 13' for convenient manual gripping by an operator for application of torque on shaft 12. Manifestly, the speed of rotation of shaft 12 is a direct function of the degree of effort expended by the operator so that, as will be more fully evident below, the relative rapidity of operation of machine A is controlled entirely by the operator; there being no dependence upon an electric motor or the like as has been the custom to the present time.

Surroundingly disposed on drive shaft 12, in sleeve-like relationship thereto, is a drive roller 12' being fabricated desirably of limitedly resilient, friction-producing material, such as, rubber, whether synthetic or natural, for work griping purposes to be described. Rockably engaged upon the lower, forward portion of main frame f is a swing frame, indicated bradly s, which is constituted of a pair of arms 14,14' the normally lower ends of which are engaged upon the ends of lower forward rod 5 immediately inwardly of side plates 1,1', respectively; said rod 5 extending through enlarged openings 15 in each arm 14, 14' which openings have their main axis longitudinally of the related arm 14, 14', as the case may be. Each opening 15 communicates interiorly of the associated arm 14, 14' with an elongatd centrally located chamber 16 proceeding coaxially of the associated arm for accommodating a coil spring 17, which latter at its normally lower end bears against the received portion of rod 5 and at its normally upper end bears against a bar 18 extending transversely between arms 14, 14' for integrating said swing frame s and with said bar 18 being held fixedly in said arms as by set screws 19. Each spring 17, being of the compression type, urges rod 5 relatively downwardly or away from bar 18; the length of opening 15 permitting of movement of arms 14, 14' relative to rod 5. Extending between arms 14, 14' at their upper ends, and in axially parallel relationship to rod 4 and bar 18, is driven shaft 20 journalled at its ends in said arms 14,14' and having a driven roller 21 disposed thereon, which latter may be relatively rigid material, for cooperation with drive roller 12'. Accordingly, it will be observed that swing frame s is thus rockable about rod 5 between forward and downard inoperative position and upward and rearward position in cooperating rerlationship with drive roller 12', said last mentioned condition being indicated in full lines in FIG. 3.

With reference particularly to FIG. 3, it will be noted that with swing frame s in rearwardly rocked position driven roller 21 will come into resting, detained position against drive roller 12' (as shown in phantom lines in said FIGURE). However, with the application of slightly downward, but primarily rearward pressure upon swing frame s, the bias of the associated coil springs 17 is overcome so that arms 14, 14' will be caused to move relatively downwardly of rod 5 with commensurate stressing of spring 17 to permit further rearward swing of frame s with such movement being determined by abutment against detents 22,22' extending from the inner sides of plates 1,1'. In such position driven roller 21 will be slightly rearwardly and beneath drive roller 12' but urged by the stress on springs 17 in a forwardly and upwardly direction into frictional engagement with drive roller 12' as along a line of contact slightly rearwardly of the lowermost point thereof for cooperating with same for web gripping purposes. Thus, springs 17 will assure of appropriate disposition of driven roller 21, and with the same engaging the rearward lower quadrant of drive roller 12' accidental disengagement therebetween is inhibited. The phantom positon shown in FIG. 3 is tantamount to a disengaged condition whereas the full lines illustrate the interlocked operating state between the said rollers 12' and 21. It is, therefore, to be observed that drive roller 12' is located sufficiently rearwardly of leading edge 8 so that swing frame s has the necessary volume in which to rock to engaged position, for proper web-pulling coaction drive roller 12' and driven roller 21.

From the foregoing the operation of machine A should be apparent. A length of web-forming backing material P having applied thereon discrete, coated labels l as presented in a plurality of longitudinally extending, laterally aligned rows, is fed to machine A being led over rearward rod 2 and thence directed downwardly and forwardly onto support plate 6 and under rod 4 for disposition about plate leading edge 8. Backing web P is then guided downwardly and rearwardly in immediate conformance to the taper 9 on leading edge 8 and under drive roller 12'. Driven roller 21 may either have been previously disposed into operative engagement with drive roller 12' (as shown in full lines in FIG. 3) or may then be locked into such condition as web P is presented beneath drive roller 12'. The relationship of drive roller 12' and driven roller 21 is such as to effect a very tight, positive, firm grasping of sheet P therebetween to pull the latter through machine A upon rotation of drive roller 12' by the manipulation of control knobs 13 or 13', or both, since the movement of roller 12' is transmitted to roller 21 through friction. By such snug gripping, backing web P closely hugs support plate leading edge 8 for assuring that the same is effectively drawn or peeled away from overlying labels l which continue in forward travel, in a fully exposed manner, beyond leading edge 8. As pointed out above, rod 4 is so disposed as to effect exertion of sufficient pressure upon the label-bearing web P moving thereunder so as to bias the labels l into forward travel and thereby promote the parting action. Thus, labels l are exposed for facile withdrawal by the operator who may discontinue rotating drive roller 12' during such withdrawal or, who, if sufficient dexterity has been developed, may be able to concurrently continue the movement of material P through machine A while picking off the freed labels l. It may be seen that the configuration of leading edge 8, with its rearward and downward taper, conduces to the label withdrawal by causing an immediate rearward peeling of a backing web P. The disposition of driven roller 21 and drive roller 12' spacedly rearewardly of leading edge 8 accommodates the customary relatively extended selvedge provided ont he leading end of webs, such as web P.

Machine A is thus constituted of a simplicity of highly durable components so that economic assembly and reliable opeation are assured. But more so, as machine A is devoid of complex motors, together with the usual control switches, such as microswitches, to bring about the usual intermittent operation, there is obviated the need for establishing a predetermined operational speed. Nor is there the necessity of having to locate machine A proximate a convenient source of electrical power. Thus, the use is free to transport the machine A to any desired location for usage. Being without an involved motor and related accessories, machine A is unlikely to experience the costly down-time for repair or parts replacement. The speed of operation, being dependent entirely upon the dexterity of the operator, may be at any pace established by the operator. Clearly the ease and economy of manufacture of machine A is self-evident as compared to structures heretofore known in this art which embody highly complex components necessitating carefully contrived coaction.

Directing attention now to FIGS. 5–8, inclusive, A' designates a manually operable label dispensing machine designed for use with backing material constituted of discrete pages or sheets P' as distinguished from lengthy webs. Such sheets have very limited selvedge in their leading end portion. Machine A' is thus dimensioned for accommodating a single sheet P' of predetermined dimensions; said machine A' incorporating a main frame f' having a pair of parallel, vertically presented, horizontally spaced-apart side plates 31, 31' maintained in such condition by lower, forward and rearward transversely extending rods 32, 33 and an upper transverse rod 34 which may be located in the upper central portion of side plates 31,31'. The three rods 32, 33, and 34 being securely engaged at their opposite ends into said plates 31,31' unify machine frame f' in a stable manner.

Immediately underlying rod 32 and extending substantially from the rear edges of plates 31,31' to a point forwardly of the forward edges thereof is a work support plate 35, being planarwise parallel to side plates 31,31'. The transverse distance between side plates 31,31' is substantially the same as the width of sheet P', so that said side plates also function as work-directing surfaces. Additionally, support plate 35 is of such front-to-back dimension as to provide support for the label portion of sheet P'; the spacing between plate 35 and rod 34 being adequate for unimpeded movement therebetween of a sheet P' carrying discrete, adhesive-coated labels l'. Work support plate 35 is mounted to side plates 31,31' in like manner as work support plate 6 with respect to side plates 1,1' to thereby simplify assembly but without diminution in reliable stability. The forward edge 36 of work support plate 35 is tapered downwardly and rearwardly on its under surface, as at 37, just as plate 6 hereinabove described, for facilitating parting of labels l' from the associated backing sheet P'.

Resting flatwise upon support plate 35 forwardly of rod 34 and being substantially coextensive with such portion of plate 35 is the base extension 38 of an L-shaped hold-down or guide member m having a relatively short, rearward vertical extension 39, the rearward face of which abuts rod 34. Projecting through each side plate 31,31' is a pair of forward and rearward pins 40,41,40'41', respectively, with the pins 40, 40' immediately overlying forward marginal portions of extension38 of member m to prevent unauthorized vertical shifting thereof to assure of cooperation of the undersurface thereof with the confronting portion of plate 35 for defining a guideway g therebetween for backing sheet P' traveling thereacross toward parting edge 36' while pins 41,41' are presented alightly relatively above pins 40,40', respectively, but immediately adjacent extension 39 so as to prevent forward movement thereof but yet allowing of slight vertical shifting to create with the underlying portion of plate 35 a mouth r into the guideway g. Thus, during operation hold down member m will rest upon sheet P' and thereby exert requisite pressure so as to urge labels l' into forward trvel and thereby conduce to the parting between the same and sheet P' as the latter is drawn about edge 36.

Rockably mounted on rod 32 is a swing frame s' being of substantially similar construction to swing frame s hereinabove described in conjunction with machine A so that like components will be ascribed like reference numerals. However, with swing frame s' a central bar 18' is presented which is in all respects structurally similar to bar 18 but projects at each of its ends beyond the associated arm 14,14', as the case may be, for extension through notches 42,42' formed in side plates 31,31' for projection beyond said latter. One of the ends, as at 43', constitutes a catch 44 for engagement with an upwardly opening keeper 45 formed in the forward end of a latch arm 46 which is swingably mounted on its rearward end on the outer face of plate 31' (see FIGS 5 and 8); said latch arm being of the simple gravaity type and restrained against downward swinging by a detent 47 projecting from side plate 31' for abutting the under surface of latch arm 46 when catch 44 is engaged. Thus, said latching arrangement prevents undesired forward swinging of frame s' into downward inoperative condition but the latter may be easily freed for such movement by the simple expedient of lifting upwardly on the forward end extremity of latch arm 46 to remove keeper 45 from catch 44.

Although swing frame s' mounts a shaft extending transversely between arms 14,14' of said swing frame s', which shaft is indicated at 48, the same is journalled for rotation in said arms 14,14' just as driven roller 21 hereinabove but differs therefrom in mounting a drive roller 48; which is of limitedly resilient, friction-producing material, such as, rubber, and with the ends of said shaft projecting through notches 42,42' in said plates 31,31', respectively, and outwardly therebeyond for mounting knurled control knobs 49,49', respectively. It will thus be seen that shaft 48 together with roller 48' constitutes a drive roller as opposed to the driven roller carried on swing frame s of machine A above described. Manifestly, the rotation of drive roller 48 is controlled by the degree of torque manually applied thereon by the operator through use of either control knob 49,49' or both.

Jounalled at its ends in side plates 31,31' immediately beneath support plate 35 and proximate the forward edges of side plates 31,31' is a shaft 50 which coacts with drive roller 48' for gripping sheet P' to pull same through machine A so as to bring about a peeling action with respect to labels l' in fundamentally the same manner as described hereinabove in conjunction with machine A. It is to be further observed that swing frames s' maintained in locked condition through cooperation of catch 44 and keeper 45 swing frame s' will be under limited tension through compression of the coil springs 17 (not shown) so as to assure of driving of driven shaft 50 upon rotation of drive roller 48' through manipulation of knobs 49,49'.

Machine A' presents a unique modification of machine A above described demonstrating the versatility of the underlying concept. With machine A' the driving roller is mounted upon the particular swing frame s' whereas with machine A the driven roller is carried upon the associated swing frame s. However, it will be noted that driven shaft 50 is located immediately adjacent the forward edge of side plates 31,31' for effecting operational engagement in its forward lower quadrant with drive roller 48 to grip the short leading end selvedge of sheet P'. Thus, the said gripping action must occur in immediate proximity to the parting edge of plate 35, otherwise labels l' would have had to have been manually removed before travel through machine A' to permit appropriate gripping action of sheet P' by said rollers. In operating condition, swing frame s will be in a forwardly and downwardly biased state wherefore the requirement for latch arm 46 becomes apparent. Only by such unusual cooperation of driven shaft 50 and drive roller 48' at their specific location on machine A could labels l' be efficienlty removed from sheet P'. It is to be particularly observed that machine A' is indeed unique in rendering it feasible to use label dispensing machines with backing material constituted of discrete sheet as opposed to the lenghty webs which have been the customary label-backing support. Such reversibility may be easily and uniquely achieved. Furthermore, the embodiments of the invention hereinabove disclosed demonstrate means for assuring of the requisite motion-transmitting relationship, as well as the maintenance of such relationship between the driving and driven members for pulling the particular backing sheet through the machine. Machine A' is mostly sturdy and one whihc can be economically manufactured. Clearly, the economy is producing either of machines A or A' will allow of inexpensive custom manufacture to accommodate backing sheets or webs of any particular size and character which features would not be readily and cheaply attainable with the complex motor-driven structures currently available.

Figure 9:
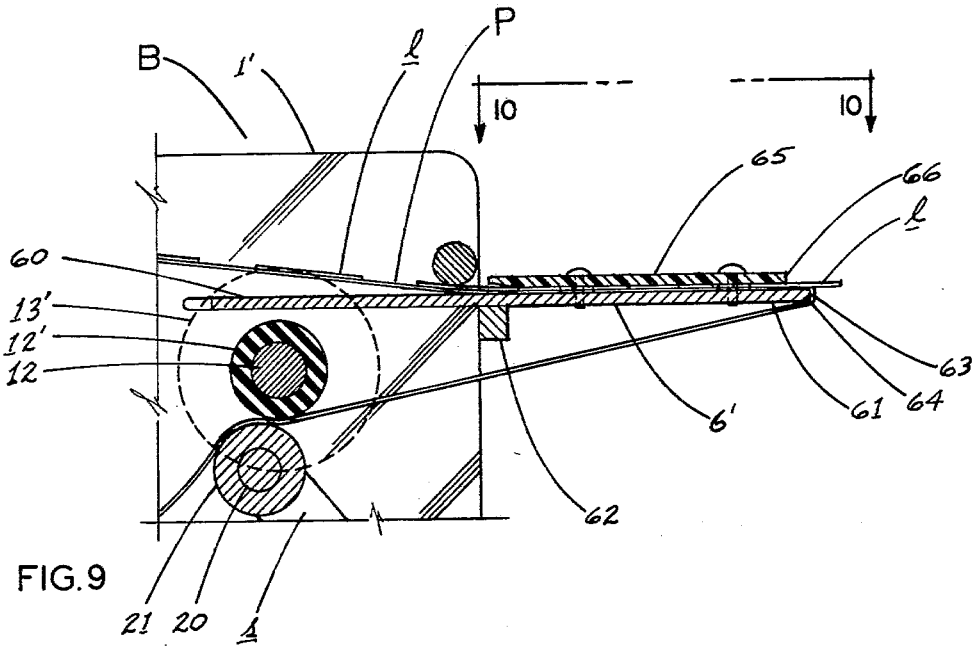
FIG. 9 is a fragmentary transverse sectional view taken substantially on the line 3—3 of FIG. 2 and illustrates another form of label dispensing machine constructed in accordance with and embodying the present invention.
Figure 10:
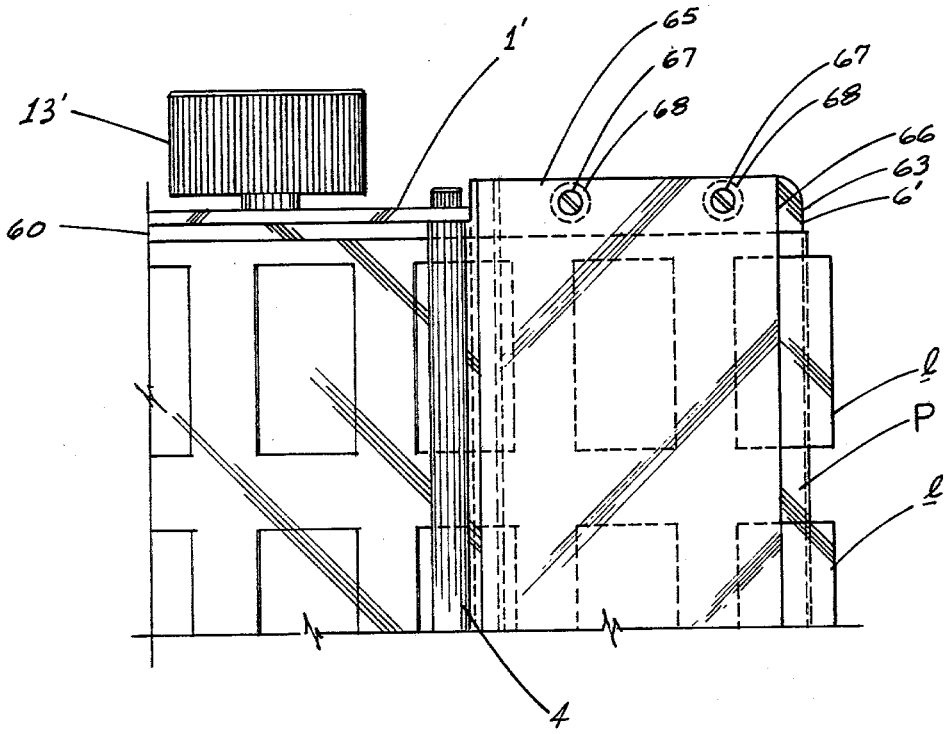
FIG. 10 is a fragmentary top plan view taken on the line 10—10 of FIG. 9.

With reference now being made to FIGS. 9 and 10, B broadly designates a label dispensing machine which is of the same fundamental character as machine A hereinabove described so that like reference numerals will be utilized to identify like components. However, machine B incorporates a work-support plate 6', having a rearward portion 60, the rearward end of which terminates spacedly from the front end edge of side plate 1' at substantially the same point as plate 6 and with said plate 6' being engaged to the side plates 1, 1' in the same manner as plate 6. The distinction between plates 6 and 6' lies in the relative extent of the forward portion 61 of plate 6', which forward portion extends substantially forwardly of the forward end edge of side plates 1, 1'. Said forward portion 61 is underlyingly buttressed by a bar 62 preferably of quadrilateral cross-section and being coincident in transverse extent therewith; which bar abuts on its rearward face against the forward edges of 1, 1' so as to resist any doward tilting tendency of forward end portion 61. In its forward end extremity, forward extension 61 is provided with a leading edge 63 which tapers downwardly and rearwardly as at 64 to provide a parting edge, as in the manner of member 8 of machine A.

Provided overlyingly of forward portion 61 throughout its transverse extent is a work-directing plate 65, the forward edge 66 of which terminates immediately rearwardly of leading edge 63. Said work-directing plate 65 is secured to forward extension 61 of support plate 6' as by screws 67 or other fasteners, but with there being spacer elements 68 of predetermined thickness disposed about stems of said screws 67 between plates 65 and 6' so as to maintain the former at a predetermined elevation with respect to support plate 6' in order to accommodate web P together with labels l thereon in such a manner as to exert prerequisite pressure to bias labels l into continued forward travel as the same move past plate 65 to thereby promote the reliable parting of said labels l from web P as the latter is drawn downwardly and rearwardly about leading edge 63 by drive roller 12 and driven shaft 20.

Accordingly, machine B, which is in all other respects similar to machine A, is provided with a novel work-directing member which may be maintained in selected disposition throughout appropriate utilization of spacers having the commensurate thickness.

Also, plate 65 may be fabricated of transparent material so that the operator may, at all times, determine the progress of the work thereunder.

Figure 11:
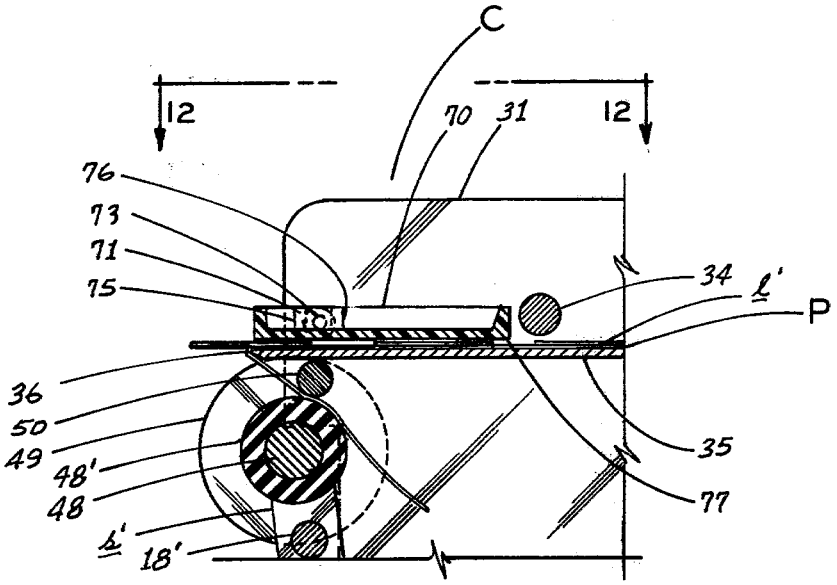
FIG. 11 is a fragmentary vertical transverse sectional view taken substantially on the line 7—7 of FIG. 6, but illustrating a further form of label dispensing machine constructed in accordance with and embodying the present invention.
Figure 12:
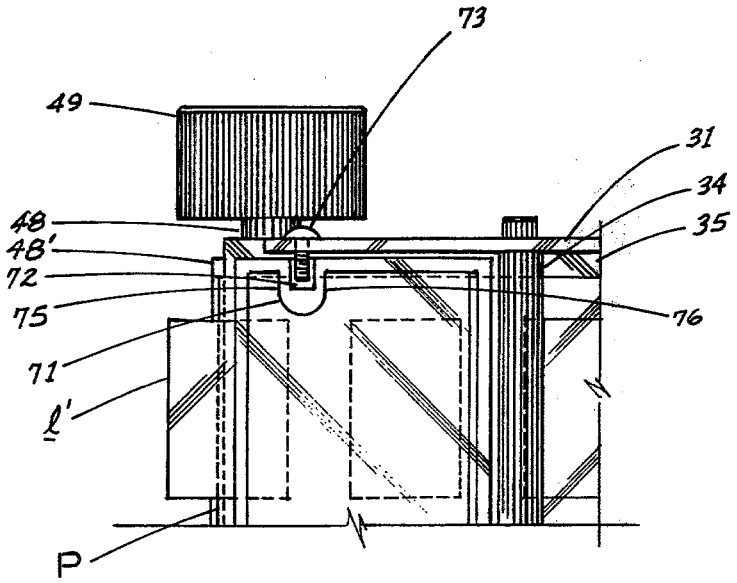
FIG. 12 is a fragmentary top plan view taken on the line 12—12 of FIG. 11.

Referring now to FIGS. 11 and 12, C designates a label dispensing machine which is fundamentally similar to machine A' so that like reference numerals will be used to identify like components. Machine C differs essentially from machine A' in being provided with a work hold-down plate 70 which overlies support plate 35 between side walls 31, 31' and with a front-to-back dimension so that the forward edge of plate 70 is located immediately rearwardly of parting edge 36 and the rearward end of plate 70 is slightly spacedly forwardly of rod 34. It will also be seen that machine A is devoid of pins 40, 41 projecting from side plates 31, 31' for restricting upward movement of plate 70.

Plate 70, which may be fabricated of transparent plastic material, if desired, is provided in each of its opposite side margins, proximate the forward ends thereof, as at 71, with a laterally outwardly opening recess 72 for extension there into of the inner ends of screws 73 or like detent members. It will thus be observed that screws 73 are presented immediately upwardly of the base 74 of the associated recess 72 so as to limit the upward movement of plate 70 as well as to be positioned for abutting the forward and rearward walls 75, 76. Thus, without positively engaging plate 70, said screws 73 serve to inhibit undesired dislocation of the same. By reason of the relatively forward location of screws 73, the same may constitute a limited pivotal axis about which plate 70 may most restrictedly rock so as to allow its rearward end to be slightly elevated with relationship to work-support plate 35, as at 77 for receiving the leading edge of sheet P with labels l' thereon.

It will thus be seen that plate 70 is so related to screws 73 as to provide a positive downward pressure upon the sheet P, being fed to machine A so as to urge labels l' in a forward direction as sheet P is led about parting edge 36 and thereby reliably conducing to the label withdrawing action.

Thus, the thickness of the base portions of recesses 72 will coact with screws 73 to provide the degree of downward pressure upon the particular sheet P commensurate with the combined thickness of the sheet and labels l' carried thereon.

Having described our invention, what we claim and desire to obtain by Letters Patent is:

1. A machine for dispensing adhesive labels from a carrier sheet comprising a main frame having a pair of spaced-apart side plates, there being a work support plate mounted on said frame for direction of said carrier sheet thereover, said work support plate having a forwardly presented leading edge, a driven member journalled at its ends in said side plates for rotation about an axis perpendicular to the plane of said side plates and being disposed downwardly of said work support plate leading edge, a sub-frame swingably mounted upon said side plates, a drive roller rotatably carried upon said sub-frame for friction-producing engagement with said driven member in one limit of said sub-frame's movement of swing for cooperating with said driven member for gripping the carrier sheet therebetween to pull said sheet downwardly about said support plate leading edge for parting of labels therefrom, and means for imparting torque to said drive roller.

2. A machine for dispensing adhesive labels as defined in claim 1 and further characterized by said means for imparting torque to said drive roller being adapted for manual manipulation and constituting at least one control knob located outwardly of the proximate side plate.

3. A machine for dispensing adhesive labels as defined in claim 2 and further characterized by means for lockingly maintaining said sub-frame in one limit of its swingable movement for maintaining same in cooperative relationship with said driven member.

4. A machine for dispensing adhesive labels as defined in claim 3 and further characterized by said locking means comprising at least one latch arm swingably mounted on one of said side plates, and a cooperative locking element carried on said sub-frame for engagement with said latch arm.

5. A machine for dispensing adhesive labels from a carrier sheet comprising a main frame having a pair of spaced-apart side plates, there being a work support plate mounted on said frame for direction of said carrier sheet thereover, said work support plate having a leading edge presented forwardly of said side plates, a drive roller journalled in said sideplates for rotation about an axis perpendicular to the planes of said side plates and disposed downwardly of said work support plate leading edge, a control knob carried on at least one end of said drive roller outwardly of the adjacent side plate for facilitating manual impartation of torque to said drive roller, a sub-frame swingably mounted upon said side plates, a driven roller carried on said sub-frame for presentation downwardly of said support plate leading edge for friction-producing engagement with said drive roller in one limit of swing of said sub-frame to cooperate with same for gripping of the carrier sheet therebetween to pull said sheet downwardly about said support plate leading edge for parting of labels from said sheet.

6. A machine for dispensing adhesive labels as defined in claims 2 or 5 and further characterized by resilient means carried in said sub-frame for urging said drive roller and said driven member toward each other in carrier sheet-pulling relationship when said sub-frame is at one limit of its swingable movement.

7. A machine for dispensing adhesive labels as defined in claims 2 or 5 and further characterized by said sub-frame comprisinga base rod secured at its ends to said side plates and transversely therebetween in the lower forward portion of said side plates, a pair of arms swingably mounted at their lower ends upon said base rod, a rigidifying cross member fixed at its ends in said arms and extending therebetween in spaced-apart relationship to said base rod, and said driven roller or said drive roller being journalled at the upper ends of said arms, and biasing means associated with each arm for urging said drive roller or driven roller away from said base rod.

8. A machine for dispensing adhesive labels as defined in claim 7 and further characterized by said biasing means comprising springs carried internally of each of said arms and bearing at their lower ends upon said base rod, there being means provided permitting relative movement of said arms in an axially perpendicular direction to said base rod.

9. A machine for dispensing adhesive labels as defined in claim 7 and further characterized by each of said arms having an axially extending chamber, each of said arms further having registering enlarged apertures the axial extent of which is greater than the diameter of said base rod, said arms being so disposed upon said base rod as to cause same to project through said apertures, a coil spring provided within the chamber of each arm and bearing at one end against said base rod and at the other ends thereof within said chambers proximate the central zones of said arms thereby urging said base rod toward the lower end of said apertures.

10. A machine for dispensing adhesive labels as defined in claim 2 and further characterized by a hold-down member provided upon the forward portion of said work support plate cooperating with same to provide a guide path therebetween for said carrier sheet.

11. A machine for dispensing adhesive labels as defined in claim 2 and further characterized by said leading edge being tapered downwardly and rearwardly on its under surface.

12. A machine for dispensing adhesive labels as defined in claim 1 and further characterized by a work hold-down member disposed above said work-support plate, means for maintaining said work hold-down member in spaced relationship to said work-support plate a distance commensurate for movement of the carrier sheets and labels thereon therebetween, but sufficiently close to exert a pressure thereon for biasing the said labels into forward travel.

13. A machine for dispensing adhesive labels as defined in claim 12 and further characterized by said means maintaining said work hold-down member in spaced relationship to the support plate comprising spacer elements.

14. A machine for dispensing adhesive labels as defined in claim 12 and further characterized by said hold-down member being substantially coextensive transversely with said work-support plate and having a forward edge spaced rearwardly from the support plate leading edge.

15. A machine for dispensing adhesive labels as defined in claim 14 and further characterized by said work hold-down member of general plate form and being fabricated of transparent material.

16. A machine for dispensing adhesive labels as defined in claim 12 and further characterized by said hold-down member being of general plate form and having laterally outwardly and upwardly opening recesses formed in its side margins, each of said recesses having a base portion of predetermined thickness, and detent members projecting into said recesses for restricting upward movement of said hold-down member to assure of application of requisite pressure upon work moving there beneath to bias the carried labels into forward travel.

17. A machine for dispensing adhesive labels as defined in claim 1 and further characterized by said driven member being presented immediately rearwardly of and beneath said support plate leading edge, and said drive roller engaging said driven roller in the forward lower quadrant thereof when said rollers are in operative relationship.

18. A machine for dispensing adhesive labels as defined in claim 17 and further characterized by said sub-frame being gravitationally biased downwardly and forwardly when said drive roller is engaged with said driven roller, and latch means inhibiting downward and forward swinging of said sub-frame for maintaining said rollers in mutually pressure-exerting relationship.

* * * * *